US008120414B2

(12) United States Patent
Albean

(10) Patent No.: US 8,120,414 B2
(45) Date of Patent: Feb. 21, 2012

(54) LOW-NOISE CURRENT SOURCE

(75) Inventor: David Albean, Indianapolis, IN (US)

(73) Assignee: Enerdel, Inc., Indianapolis, IN (US)

( * ) Notice: Subject to any disclaimer, the term of this patent is extended or adjusted under 35 U.S.C. 154(b) by 0 days.

(21) Appl. No.: 12/791,420

(22) Filed: Jun. 1, 2010

(65) Prior Publication Data

US 2011/0291745 A1 Dec. 1, 2011

(51) Int. Cl.
*G05F 1/10* (2006.01)
*G05F 3/02* (2006.01)

(52) U.S. Cl. ..... 327/538; 327/540; 327/534; 327/547

(58) Field of Classification Search ..... 327/538–543; 323/315–316

See application file for complete search history.

(56) References Cited

U.S. PATENT DOCUMENTS

| | | | | |
|---|---|---|---|---|
| 3,168,650 | A * | 2/1965 | Sheffet | 327/574 |
| 3,236,946 | A | 2/1966 | Hansen et al. | |
| 3,365,670 | A * | 1/1968 | Sheffet | 455/308 |
| 3,584,262 | A * | 6/1971 | Gary | 361/198 |
| 3,595,993 | A | 7/1971 | Pratt | |
| 4,352,030 | A * | 9/1982 | Beesley | 327/58 |
| 4,486,718 | A | 12/1984 | Sugawara | |
| 5,030,922 | A | 7/1991 | Rumreich et al. | |
| 5,357,089 | A * | 10/1994 | Prentice | 330/298 |
| 5,760,571 | A | 6/1998 | Latham et al. | |
| 6,201,380 | B1 | 3/2001 | Tsujino | |
| 6,603,293 | B2 | 8/2003 | Knoedgen | |
| 7,202,645 | B2 | 4/2007 | Grove | |
| 2009/0237108 | A1 | 9/2009 | Kurokawa | |
| 2010/0277230 | A1 * | 11/2010 | Ngai | 327/543 |

FOREIGN PATENT DOCUMENTS

| | | | |
|---|---|---|---|
| JP | 63-015505 | | 1/1988 |
| JP | 63015505 | * | 1/1988 |
| JP | 2006-333647 | | 12/2006 |

* cited by examiner

*Primary Examiner* — Lincoln Donovan
*Assistant Examiner* — Brandon S Cole
(74) *Attorney, Agent, or Firm* — Faegre Baker Daniels LLP

(57) ABSTRACT

A low noise current source includes first and second voltage input terminals. The current source further includes an amplifying device having an input terminal and an output terminal, where the output terminal is coupled to the second voltage input terminal via a load. The current source also includes a bias circuit coupled between the first voltage input terminal, the second voltage input terminal, and the input terminal. The current source additionally includes a first bypass circuit coupled between the first voltage input terminal and the input terminal, where the first bypass circuit configured to provide a substantially high electrical resistance and substantially no electrical impedance between the first voltage input terminal and the input terminal.

26 Claims, 5 Drawing Sheets

LOW-NOISE CURRENT SOURCE

FIELD OF THE INVENTION

The subject matter herein generally relates to electrical current sources and in particular, to low-noise, electrical current sources.

BACKGROUND

In general, some types of electronic devices are designed to use a current source to provide power or charging currents to one or more portions of the device. Additionally, such current sources can also be used to generate sensor or control signals for one or more portions of such devices. However, physical current sources generally fail to behave ideally and typically fail to provide a constant current at all times. Instead, the current that is provided typically varies over time, thus resulting in noise. In some devices, the magnitude of the noise may not affect the operation of the device. However, in other devices, the magnitude of the noise can be at sufficient levels to cause damage to the device or to cause the device to operate improperly. For example, in the case of a current source providing control or sensor signals, a sufficient amount of noise can result in the control system of the device inadvertently changing operational modes. In another example, the variation in current can result in overloading or overheating of a circuit, leading to reliability issues with such devices. In yet another example, the variation in current could result in improper charging of a battery or other charge storage device, leading to a reduction in the capacity or life of such devices.

As described above, one of the difficulties with the design of electronic devices is the non-ideal behavior of most current sources. That is, in most current source circuits, the voltages and/or currents therein may vary and can result in a time varying component, i.e., noise, appearing in the output current. In some cases, this noise can be significant depending on the configuration of the current source. For example, one common configuration for a current source is to utilize a voltage supply with a bipolar junction transistor (BJT) in a current source configuration using a resistor voltage divider network to provide a bias voltage for the base of the BJT from the voltage supply.

Unfortunately, such a configuration is susceptible to generation of significant output noise due to variations in the output of voltage supply and noise in the voltage supply lines. With respect to noise in a current source circuit, the BJT effectively operates as two types of amplifiers, each associated with one of the two current paths from the voltage supply to the load. In the first path, from emitter to collector, the BJT operates as a common base amplifier with a non-inverting gain. In the second path, from base to collector, the BJT operates as a common-emitter amplifier with an inverting gain. Typically, when a BJT current source is designed, the resistors in the voltage divider network and the resistance and load at the emitter and collector, respectively, are selected such that the gains in the two paths are approximately equal and opposite in polarity to cancel at least small amounts of noise. However, as greater amounts of noise are generated at the voltage supply, the gains become increasingly unequal, resulting in significant noise in the output current.

SUMMARY

Embodiments of the invention concern low noise current sources. In a first embodiment of the invention, a low noise current source is provided. The current source includes first and second current output terminals and first and second voltage input terminals, where the second voltage input terminal is coupled to the second current output terminal. The current source also includes an amplifying device includes a device input terminal and a device output terminal coupled to the first current output terminal. The current source further includes a bias circuit coupled between the first voltage input terminal, the second voltage input terminal, and the device input terminal. Additionally, the current source includes a first bypass circuit coupled between the first voltage input terminal and the device input terminal, the first bypass circuit configured to provide a substantially high electrical resistance and substantially no electrical impedance between the first voltage input terminal and the device input terminal.

In a second embodiment of the invention, a low noise current source is provided. The current source includes first and second current output terminals and first and second voltage input terminals, where the second voltage input terminal is coupled to the second current output terminal. The current source also includes a transistor having a control node, a first current node, and a second current node, the first current node coupled to the first voltage input terminal and the second current node coupled to the first current output terminal. The current source further includes a bias circuit coupled between the first voltage input terminal, the second voltage input terminal, and the control node. Additionally, the current source includes a first bypass circuit coupled between the first voltage input terminal and the control node, the first bypass circuit configured to provide a substantially high electrical resistance and substantially no electrical impedance between the first voltage input terminal and the control node.

In a third embodiment of the invention, a method of providing low noise current using a bipolar junction transistor having a base, an emitter, and a collector. The method includes coupling the emitter to a first voltage input terminal of a direct current (DC) voltage supply, coupling the collector to a first load terminal of a load, and coupling a second voltage input terminal of the DC supply to a second load terminal of the load. The method also includes generating a bias voltage at the base using a bias circuit coupled between the first voltage input terminal, the second voltage input terminal, and the base. Further, the method includes providing a first bypass current path between the first voltage input terminal and the base having a substantially high electrical resistance and substantially no impedance.

BRIEF DESCRIPTION OF THE DRAWINGS

Embodiments of the present application will now be described, by way of example only, with reference to the attached Figures, wherein.

DETAILED DESCRIPTION

Figure 1:
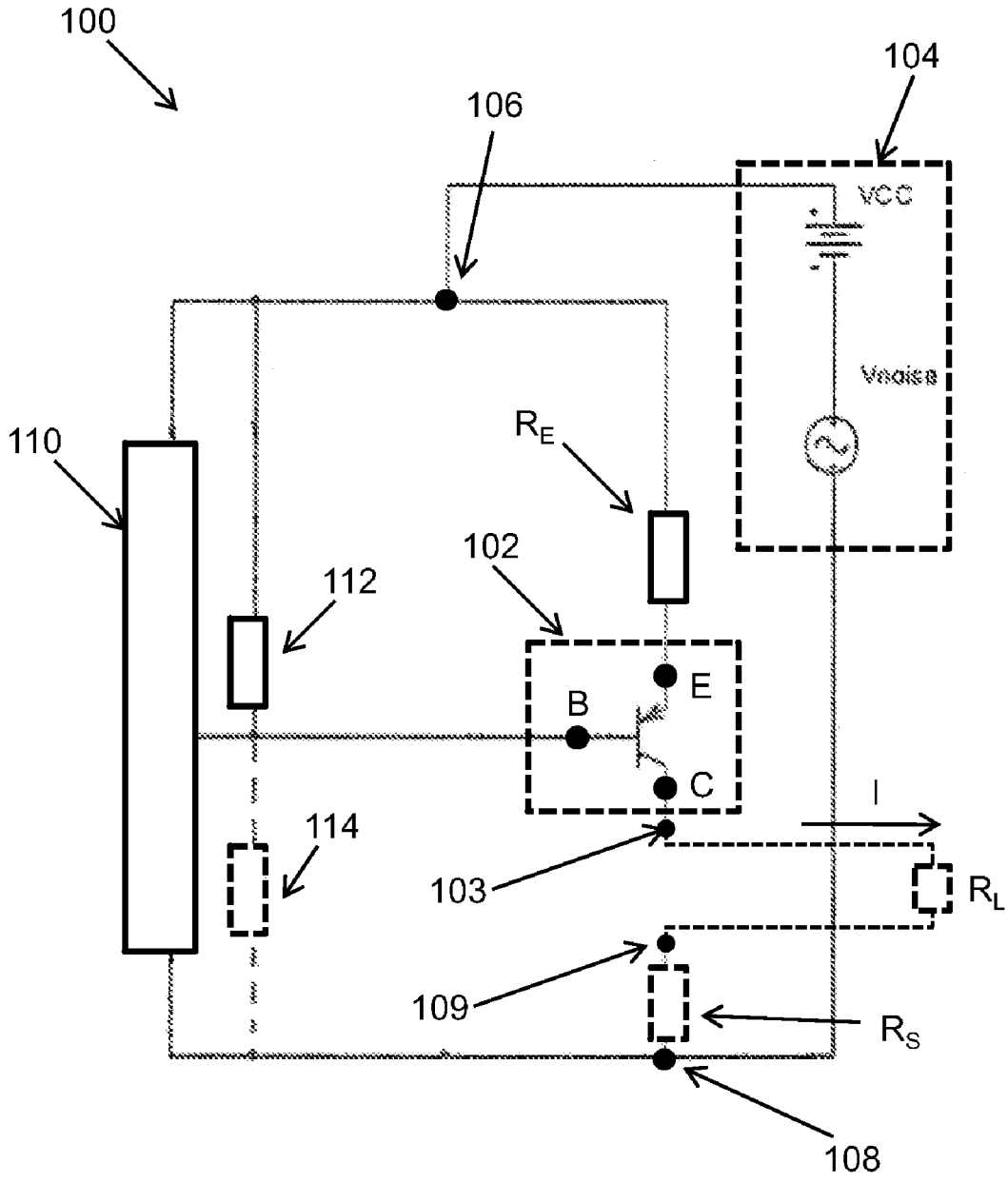
FIG. 1 shows a block diagram of an exemplary BJT-based current source in accordance with an embodiment of the invention.

The present invention is described with reference to the attached figures, wherein like reference numerals are used throughout the figures to designate similar or equivalent elements. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

In view of the limitations of conventional current sources, embodiments of the invention provide amplifying device-based current sources which are configured to substantially eliminate any noise generated at a voltage supply powering the current source from appearing in the output current. As used herein, the term "amplifying device" refers to any electronic component configured for generating an electronic signal, such as a voltage or current, in response to an input voltage, where the amplitude of the electronic signal is proportional to the input voltage. In the various embodiments an amplifying device can include semiconductor-based and valve based amplifiers. For example, an amplifying device can include BJTs, field effect transistors (JFET, MOSFET, etc., . . . ), operational amplifiers, or any combinations thereof.

In particular, embodiments of the invention provide a new current source design having a substantially resistive bias circuit for applying a bias voltage to the amplifying device. This new current source design also includes a bypass circuit, with substantially no impedance, coupled between a control node or input terminal of the amplifying device and a voltage input terminal connected to the voltage supply. As a result, time-varying components of the voltage supply (i.e., high frequency components) effectively bypass the resistive bias circuit. Therefore, the bias voltage produced by the resistive bias circuit is not significantly affected by the amount of noise in the voltage supply. Accordingly, the amount of variation, i.e., noise, in the output current at an output terminal or current node of the amplifying device is significantly reduced.

Historically, the amount of noise in conventional current supplies has been controlled via the design of the voltage supply. That is, the voltage supply is configured to produce little or no noise in order to prevent variations in the bias voltage for the amplifying device. Further, little, if any, efforts have been directed to dealing with reducing noise elsewhere. That is, it has been generally assumed that the reduction of noise in the voltage source is sufficient for providing low noise current sources. However, the focus on the voltage supply aspects of current sources has generally ignored and/or failed to address two common issues in current source circuits. First, noise may still be introduced at the connection of the voltage supply to the current source circuit. For example, electromagnetic interference can introduce noise which can generate noise at the output of the current source circuit even when no noise is directly introduced by the voltage supply. Second, because conventional low noise current source designs generally relay on low noise voltage supplies, a lower level of noise is generally attained in existing current source circuits only by replacement of the voltage supply or the entire current source. In some cases, such an approach can be costly or difficult to implement.

The various embodiments of the invention address such issues by providing low noise current sources without requiring low noise voltage supplies. In particular, by providing the bypass circuit in the current source circuit, a low noise current source can be realized using potentially any voltage supply available, regardless of its inherent noise. As a result, costs associated with the design, fabrication, refit of current sources can be reduced.

FIG. 1 shows a block diagram of an exemplary BJT-based current source 100 in accordance with an embodiment of the invention. Although FIG. 1 shows a BJT as the amplifying device, this is solely for explanatory purposes. In the various embodiments of the invention, any type of amplifying device can be used in place of the BJT in FIG. 1.

As shown in FIG. 1, current source 100 includes a PNP-type BJT 102 and a voltage supply 104 for providing a direct current (DC) voltage VCC across voltage input terminals 106 and 108. As in a conventional BJT-based current supply, the emitter (E) of BJT 102 (first current node of the transistor) is coupled to the first terminal 106 (at a voltage VCC) of supply 104 with a resistance $R_E$ therebetween. The resistance $R_E$ can be provided by a contact resistance, a line resistance, and/or at least one resistor element.

In current source 100, the collector (C) of BJT 102 (second current node or device output terminal of the transistor) serves as a source of the output current (I) for a load, defining a first current output or load terminal 103. The second voltage input terminal 108 serves as a sink for the output current of BJT 102, and therefore defines a second current output or load terminal 109. In FIG. 1, the load resistance $R_L$ represents the resistance of the device or system receiving the current from current source 100. In some embodiments of the invention, as shown in FIG. 1, a sense resistance can be provided as a means for monitoring the amount of output current for current source 100. Such a resistance can be positioned in series with the load resistance $R_L$. For example, as shown in FIG. 1, a sense resistance $R_S$ is used to couple the second voltage input terminal 108 to second current output terminal 109. However, the various embodiments of the invention are not limited in this regard. That is, alternatively or combination with sense resistance $R_S$, a sense resistor can also used to couple the collector (C) to the first current output terminal 103.

As shown in FIG. 1, current source 100 also includes a resistive bias circuit 110, providing a voltage divider for applying a bias voltage different than VCC at the base (B) of BJT 102 (i.e., the control node or input terminal of the transistor). In the various embodiments of the invention, the resistive bias circuit 110 is configured to provide a bias voltage between the voltage at first terminal 106 and the voltage at second voltage input terminal 108. Further, the resistive bias circuit 110 is coupled to the first terminal 106, the second terminal 108, and the base of BJT 102 and is configured to provide a substantially resistive current path therebetween. The effective resistances of the resistive bias circuit 112 and resistive elements $R_E$, $R_L$, and $R_S$ can be selected to provide a desired output current (i.e., a desired collector current) for a given BJT device and a value for VCC.

Unfortunately, the BJT 102 in current source 100 effectively operates as an amplifier of noise in the voltage supply 104. In particular, the BJT 102 operates as a common-base amplifier from base to collector and a common-emitter amplifier for emitter to collector, as described above. Thus, BJT 102 provides an amplification of noise that is equal to the sum of the common-emitter gain and the common base gain. In general, the common-emitter gain and the common-base gain of the BJT 102 are dependent on the ratio of the resistance at the collector of the BJT 102 (i.e., $R_L+R_S$) and the resistance at the emitter of the BJT 102 (i.e., $R_E$). The non-inverting common-base gain is equal to $(R_L+R_S)/R_E$. The inverting common-emitter gain is equal to $-k(R_L+R_S)/R_E$, where k is the voltage divider ratio of the input impedance $r_B$ at the base of the BJT 102 (i.e., the input impedance at B) and the resistance $R_B$ of resistive bias circuit 110. Thus, when $k\approx1$, (i.e., $R_B<<r_B$) these gains cancel out and little or no amplification of noise occurs. However, $k\neq1$ is the more common condition. Therefore, when a significant amount of noise occurs at supply 104 (represented by source $V_{NOISE}$ in FIG. 1), a significant difference between the magnitudes of common-base and common-emitter gains can occur. As a result, a significant amplification of noise from the supply can occur, resulting in noise in the output current (i.e., the collector current).

Accordingly, embodiments of the invention provide for forcing a value for k to approach 1 by use of bypass elements for the noise components in the current source 100. In particular, as shown in FIG. 1, a bypass circuit 112 can be provided between the first voltage input terminal 106 and the base of BJT 102. In the various embodiments of the invention, the bypass circuit 112 is configured to provide a path between first voltage input terminal 106 and the base of BJT 102 that has substantially no impedance but that has a high DC resistance. For example, bypass circuit 112 can comprise at least one capacitor connecting first voltage input terminal to the base of BJT 102. As a result, the connection via bypass circuit 112 appears as an open circuit to the DC component of the signals from supply 104 and as a short circuit to the high frequency (i.e., noise) components of the signals from supply 104. Therefore, the DC component of the signals from supply 104 is routed through resistive bias circuit 110 to bias BJT 102. In contrast, the high frequency components of the signal from supply 104 at the terminal 106 are effectively shorted to the base of BJT 102. As a result, the high frequency components are effectively removed from the voltage divider, resulting in $k\approx1$. That is, $R_B<<r_B$, with respect to $V_{NOISE}$, since the base is shorted to the voltage input terminal 106. Thus, the common-emitter gain remains approximately $-(R_L+R_S)/R_E$, substantially cancelling out the common-base gain $(R_L+R_S)/R_E$. Accordingly, the noise in the voltage supply is effectively removed from the output of current source 100.

In some embodiments of the invention, a second bypass circuit 114 can also be provided to ensure a complete bypass of resistive circuit 110 by the high frequency components of the signals from supply 104. The second bypass circuit 114 provides a path between second voltage input terminal 108 and the base of BJT 102 that also has substantially no impedance but that has a high DC resistance. For example, bypass circuit 114 can also include at least one capacitor between terminal 108 and the base of BJT 102. Thus, bypass circuits 112 and 114 appear as open circuits to the DC component of the signals from supply 104 and as short circuits to the high frequency (i.e., $V_{NOISE}$) components of the signals from supply 104. As a result, the DC component of the signals from supply 104 is routed through resistive bias circuit 110 and the noise component of the signals from supply 104 completely bypasses the resistive bias circuit 110. Consequently, with respect to the noise component of the signals from supply 104, the shorting of the base to the first and second voltage input terminal the voltage divider described above results in $R_B<<r_B$ since the base is shorted to the both supply terminals 106 and 108. Thus, $k\approx1$ and as described above, the common-emitter gain approaches $-(R_L+R_S)/R_E$ as k approaches 1, thus substantially cancel out the common-base gain $(R_L+R_S)/R_E$. Thus, the noise in the voltage supply is effectively removed from the output of current source 100.

Figure 2:
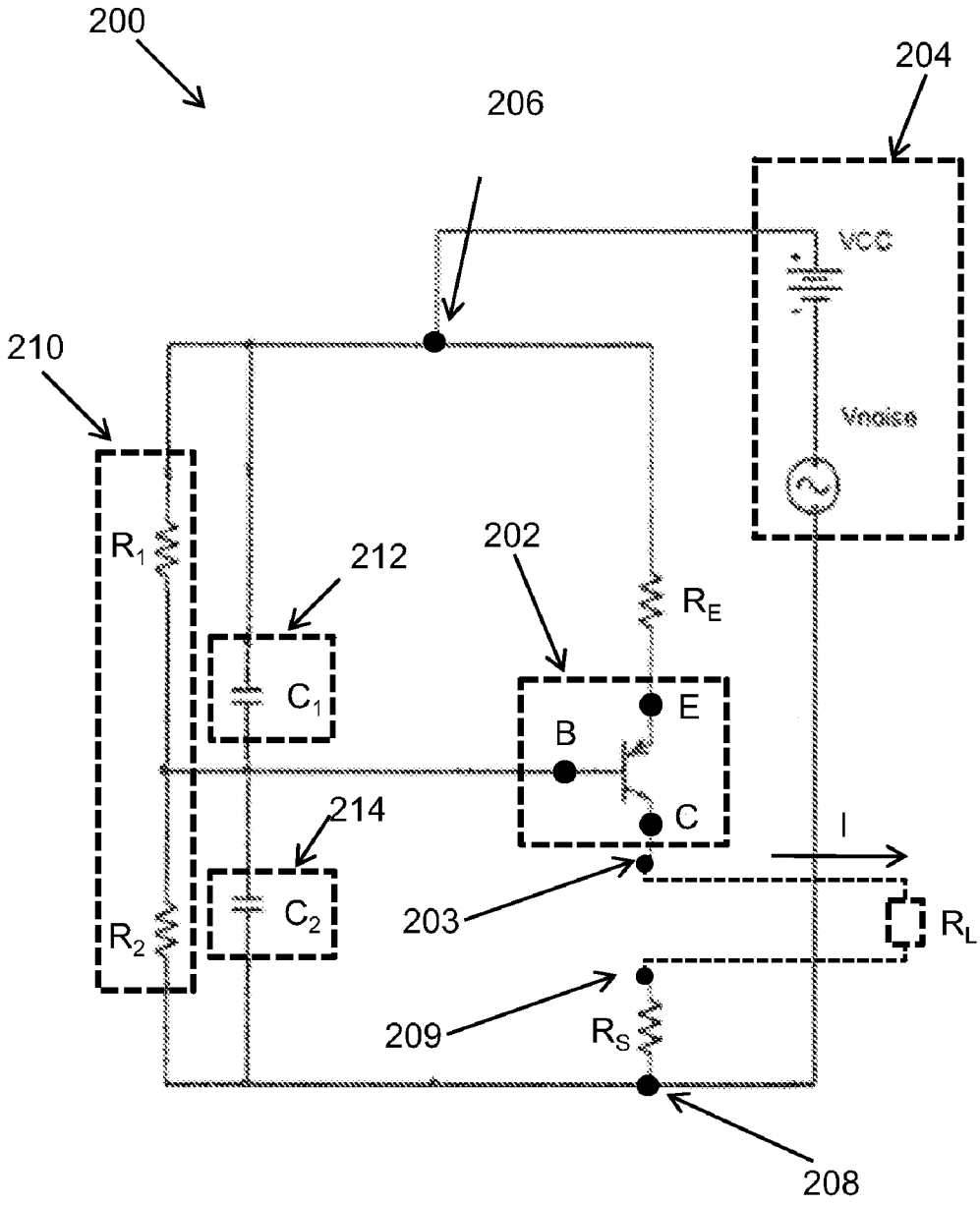
FIG. 2 shows a detailed block diagram of an exemplary BJT-based current source in accordance with an embodiment of the invention.

FIG. 2 shows a detailed block diagram of a preferred embodiment of a BJT-based current source 200 in accordance with an embodiment of the invention. Similar to current source 100, current source 200 also includes a BJT 202 and a voltage supply 204 for providing a voltage VCC across voltage input terminals 206 and 208. Further, the emitter (E) of the BJT 202 is similarly connected to a first voltage input terminal 206 via an emitter resistor $R_E$ and the collector (C) of the BJT 202 is connected to a first current output or load terminal 203. Also, similar to FIG. 1, a second voltage input terminal 208 is coupled to a second current output terminal 209. As described above, the sense resistor $R_S$ can be coupled in series with the load resistance $R_L$ to monitor an output current (I) of current source 202.

Similar to current source 100, current source 200 also includes a resistive bias network 210 coupled to the base of BJT 202 and voltage input terminals 206 and 208. In the exemplary embodiment illustrated in FIG. 2, resistive bias network 210 is implemented as a first resistance $R_1$ connecting the base of BJT 202 to voltage input terminal 206 and a second resistance $R_2$ connecting the base of BJT 202 to voltage input terminal 208. Although shown as single resistors in FIG. 2, each of resistances $R_1$ and $R_2$ can also be implemented via a network of two of more resistive elements. Thus, resistances $R_1$ and $R_2$ would represent the equivalent resistances of such networks.

In addition to the above-mentioned components, current source 200 also includes a first bypass circuit 212 connecting voltage input terminal 206 to the base of BJT 202. In the exemplary embodiment illustrated in FIG. 2, first bypass circuit is 212 implemented as a capacitor $C_1$ to provide an open circuit for DC signals and a short circuit for high frequency (i.e., noise) signals. Thus, when supply 204 includes noise (designated by $V_{NOISE}$ in supply 204), the noise signals bypass $R_1$ and are delivered directly to the base of BJT 202. Further, current source 200 also includes a second bypass circuit 214 connecting voltage input terminal 208 to the base of BJT 202. Second bypass circuit is shown in FIG. 2 as being implemented using a capacitor $C_2$ to provide an open circuit for DC signals and a short circuit for high frequency (i.e., noise) signals. Thus, the high frequency components of the signal from supply 204 are also routed around $R_2$. Consequently, the voltage divider for k becomes independent of $R_1$ and $R_2$, resulting in $k\approx1$. Therefore, any differences in the common-emitter and common-base gains due to $V_{NOISE}$ are effectively eliminated and little or no noise appears in the current through $R_L$.

Although $C_1$ and $C_2$ are shown in FIG. 2 as individual, discrete capacitors, the various embodiments of the invention are not limited in this regard. Rather, $C_1$ and $C_2$ can be implemented using any number of capacitors so as to provide a high DC resistance and substantially low impedance for one or more frequencies of interest. Selection of capacitor values to provide low impedance for high frequency signals is well-known to those of ordinary skill in the art and will not be described herein. Further, the configuration of bypass circuits 212 and 214 is not limited to solely capacitor elements. Rather, any types of components can be used in bypass circuits 212 and 214 as long as their combination provides a substantially high DC resistance and substantially low impedance. Additionally, in some embodiments of the invention, a single bypass circuit can be provided. In such embodiments of the invention, the single bypass circuit can be coupled to the first terminal 206, the base of BJT 202, and optionally to the second terminal 208.

As described above, the values for $R_1$, $R_2$, $R_E$, $R_L$, and $R_S$ can be selected so as to provide the desired output current based on VCC and the characteristics of BJT 202. Additionally, although $R_1$, $R_2$, $R_E$, $R_L$, and $R_S$ are shown as individual and/or discrete resistors, the various embodiments of the invention are not limited in this regard. Rather, these resistors can be implemented using any number or arrangement of electrically resistive elements. Thus, resistors $R_1$, $R_2$, $R_E$, $R_L$, and $R_S$ can each represent a network of electrically resistive elements.

In the various embodiments of the invention described above, the current sources in FIGS. 1 and 2 are implemented using PNP-type BJTs. However, the various embodiments of the invention are not limited in this regard. In other embodiments of the invention, a current source can be configured using a NPN-type transistor. In such embodiments of the invention, the configuration the current source circuit is substantially similar, with the exception that terminals 108, 208 are at VCC and terminals 106, 206 are at 0V or ground (assuming the same position for the emitter and collector shown in FIGS. 1 and 2). As a result, elements 112 and 212 would initially short the base of BJTs 102 and 20, respectively to ground, not VCC.

However, the current loop implemented using a PNP BJT provides a more conventional means of detection of a compromise in VCC. In a current source based on a PNP BJT, a high voltage (i.e., the voltage across $R_S$ when current is flowing) would be generated if the loop is intact and, a low voltage otherwise (i.e., no current flowing through $R_S$). In the case of an NPN BJT, a low voltage is generated if the loop is intact and a high voltage otherwise. However, a high voltage signal is preferred in most implementations to positively indicate that a loop or other circuit component is intact.

Further, the various embodiments of the invention can be implemented using any other type of amplifying device. For example, the BJT 102 in FIG. 1 can be substituted for any type of field effect transistor. In such a configuration, the gate, drain, and source of the field effect transistor can be coupled to the same terminals as the base, emitter, and collector, respectively, of the BJT 102 and operated in a similar fashion. In another example, a current source circuit can be implemented using a operational amplifier (op-amp) having a resistive bias circuit for biasing an input port of the op-amp. In such a configuration, a bypass circuit can also be provided between a voltage supply terminal coupled to the resistive bias circuit and an input terminal (typically the non-inverting input) in order to prevent a high frequency component from modifying the output voltage of the op-amp across a load and/or sense resistor and introduce noise into the output current.

EXAMPLES

The following non-limiting examples serve to illustrate selected embodiments of the invention. It will be appreciated that variations in proportions and alternatives in elements of the components shown will be apparent to those skilled in the art and are within the scope of embodiments of the present invention.

A current source circuit in accordance with the various embodiments of the invention was simulated using PSPICE and thereafter prototyped for physical testing. In particular, the current source circuit was configured in accordance with the configuration of the current source circuit shown in FIG. 2. For purposes of the simulation, the current source circuit was configured to as follows:

VCC=12 VDC
$R_1$=277Ω
$R_2$=909Ω
$R_E$=17.8Ω
$R_S$=40.2Ω
$C_1$=0.1 uF
$C_2$=0.1 uF

Figure 3:
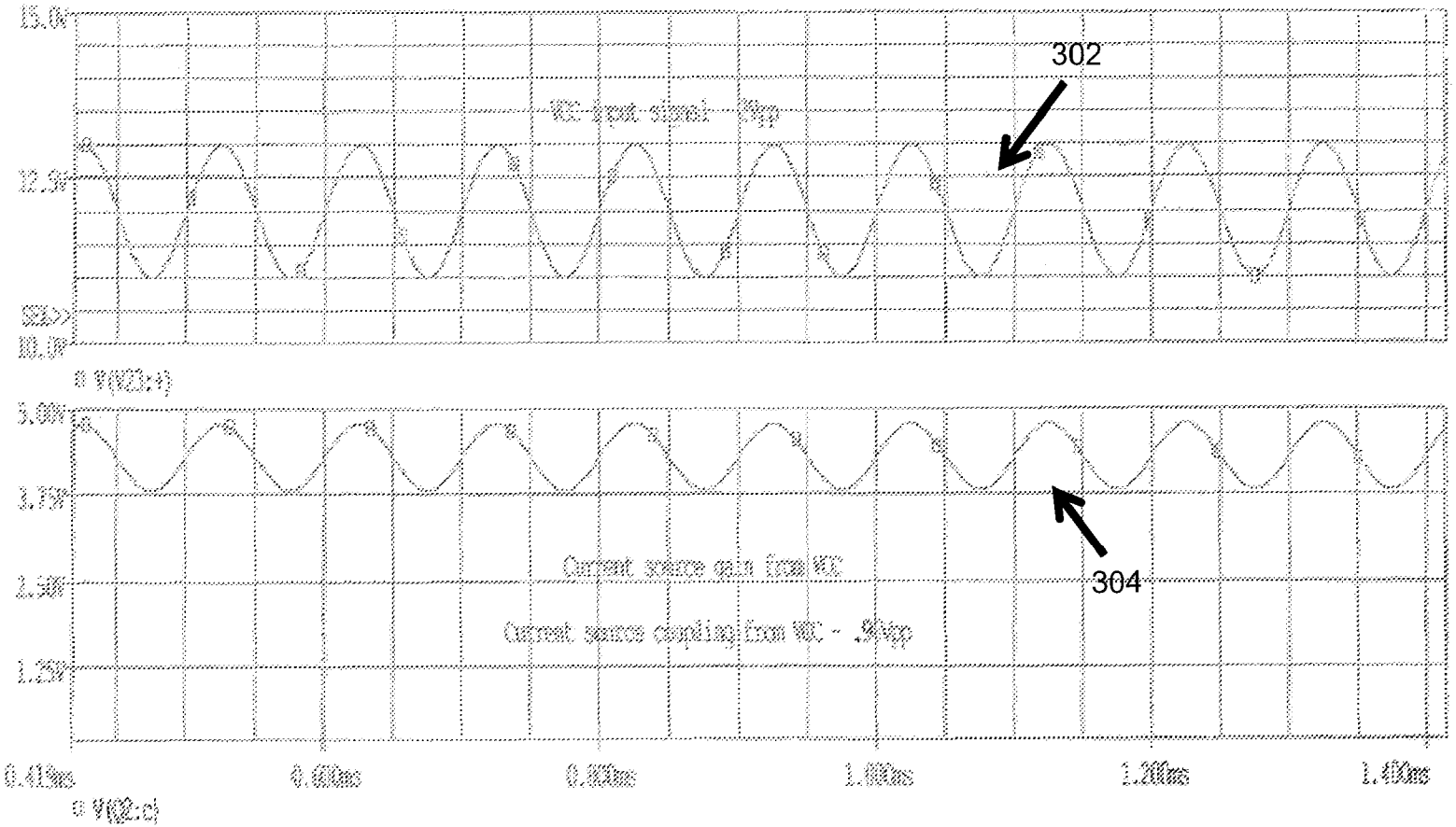
FIG. 3 shows the simulation results of noise amplification for a PNP BJT-based current source excluding bypass circuitry.
Figure 4:
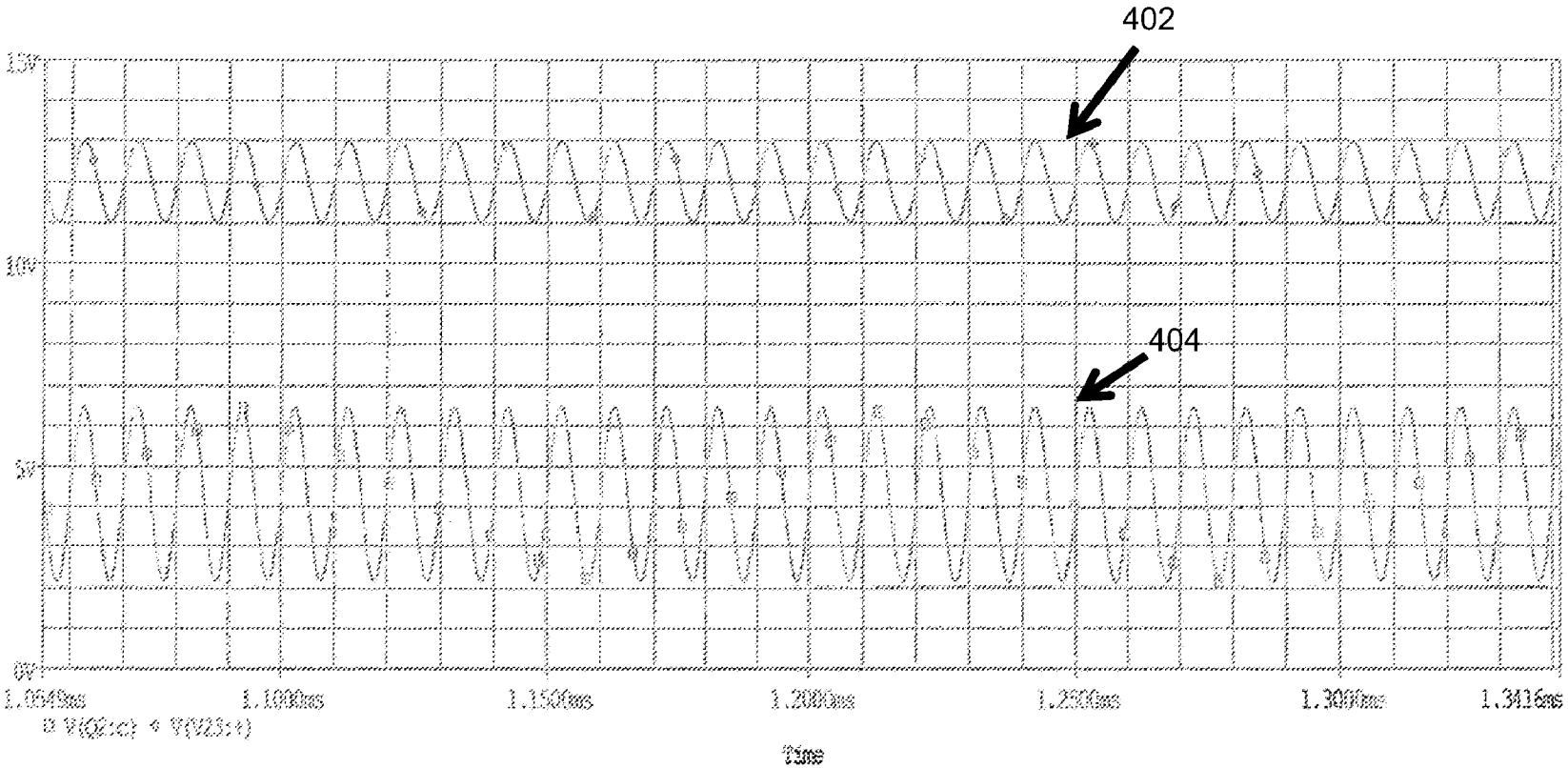
FIG. 4 shows the simulation results of noise amplification for a PNP BJT-based current source including a bypass circuit configuration for bypassing a base of the PNP BJT.
Figure 5:
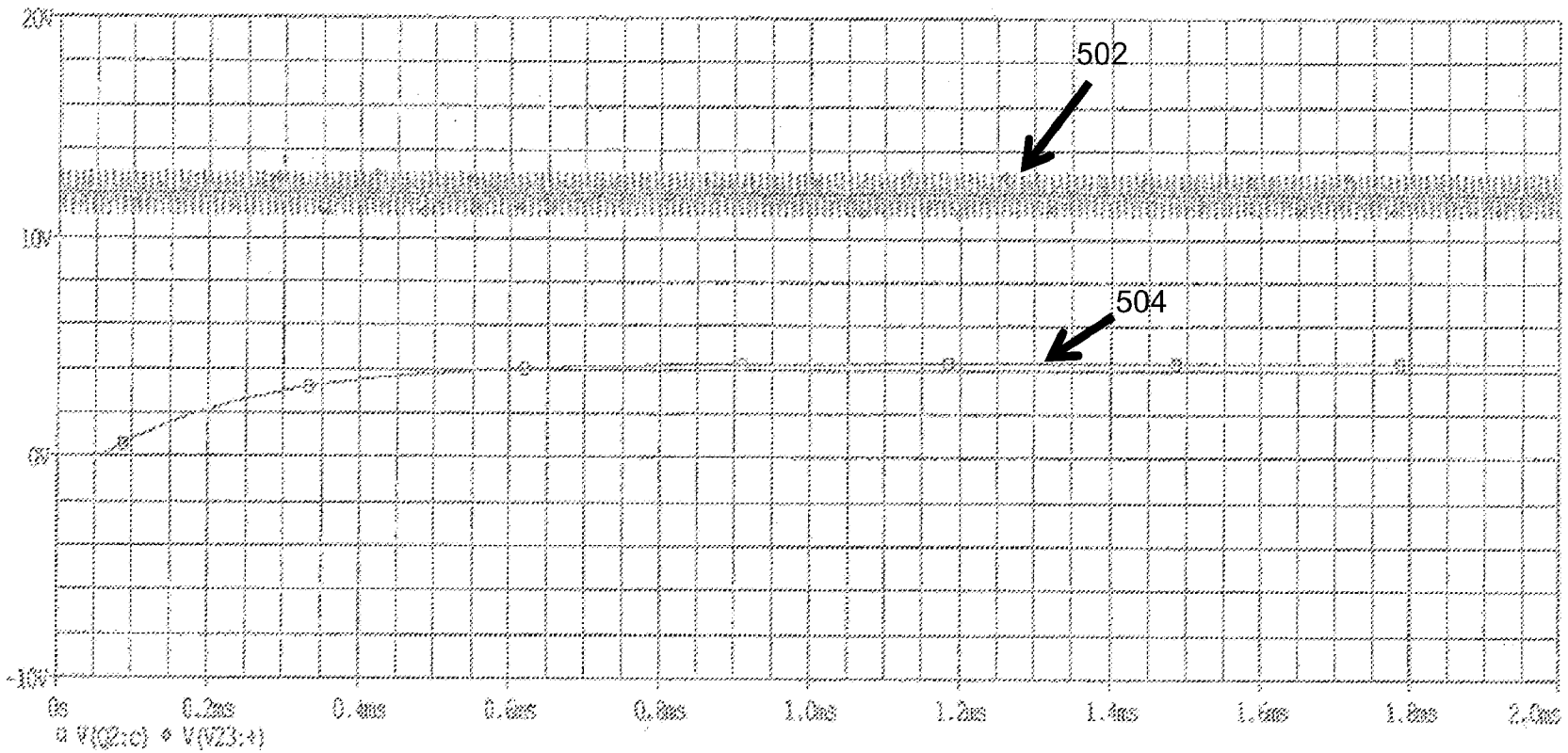
FIG. 5 shows the simulation results of noise amplification for a PNP BJT-based current source including a bypass circuit in accordance with an embodiment of the invention.

In the simulation and testing, a BC856A PNP BJT was used for the BJT. $V_{NOISE}$ was simulated and tested as a 2V peak-to-peak (PP) signal 10 kHz sine wave signal. Further, as $R_L$ is expected to provide substantially low impedance, $R_L$ was excluded for purposes of simplifying the simulations. Using these parameters, three scenarios were simulated and tested: (1) current source excluding $C_1$ and $C_2$; (2) including $C_2$ (i.e., to bypass $R_2$ and the base of the BJT) and excluding $C_1$; and (3) including $C_1$ (i.e., to bypass $R_1$) and excluding $C_1$. The simulation results are shown in FIGS. 3, 4, and 5. FIG. 3 shows simulation results of noise amplification for the first scenario: a PNP BJT-based current source excluding bypass circuitry. FIG. 4 shows the simulation results of noise amplification for the second scenario: a PNP BJT-based current source including a bypass circuit configuration for bypassing a base of the PNP BJT. FIG. 5 shows the simulation results of noise amplification for the third scenario: a PNP BJT-based current source including a bypass circuit in accordance with an embodiment of the invention.

In the first scenario, because neither $R_1$ nor $R_2$ are bypassed, $k \neq 1$. As a result, the common-emitter gain and the common-base gains do not cancel out. The simulation results in FIG. 2 show that the input 2V PP noise signal (curve 302) appears at the output (i.e., the collector node) as a 0.96V PP signal (curve 304). Thus, a gain of 0.96/2=0.48 is provided at the output. In the physical device, a similar gain was observed, specifically a gain of 0.6.

In the second scenario, the use of $C_2$ and exclusion of $C_1$ results in the bypass of the base of BJT. Accordingly, the common-emitter gain is reduced to approximately zero and only the common-base gain is observed at the collector node. The simulation results in FIG. 4 show that since no common-emitter gain is provided for cancelling the common-base gain, the input 2V PP noise signal (curve 402) appears at the output (i.e., the collector node) as a 5V PP noise signal (curve 404). Thus, a gain of 5/2=2.5 is provided at the output. In the physical device, a similar gain was observed, specifically a gain of 3.2.

In the third scenario, the use of $C_1$ and exclusion of $C_2$ results in the bypass of $R_1$. As described above, this provides a $k \approx 1$ and therefore the common-emitter and common-base gains are approximately equal at the collector node. The simulation results in FIG. 5 show that since the common-emitter gain cancels the common-base gain, the input 2V PP noise signal (curve 502) appears at the output (i.e., the collector node) as ~0V PP noise signal (curve 504). Thus, little or no noise signals appear at the collector node and a gain of zero is provided at the output. In the physical device, a similar gain was observed, specifically a gain of 0.029.

Applicants present certain theoretical aspects above that are believed to be accurate that appear to explain observations made regarding embodiments of the invention based primarily on solid-state device theory. However, embodiments of the invention may be practiced without the theoretical aspects presented. Moreover, the theoretical aspects are presented with the understanding that Applicants do not seek to be bound by the theory presented.

While various embodiments of the present invention have been described above, it should be understood that they have been presented by way of example only, and not limitation. Numerous changes to the disclosed embodiments can be made in accordance with the disclosure herein without departing from the spirit or scope of the invention. For example, in some embodiments of the invention, the bypass elements can be adjustable. That is, a capacitor between the voltage supply and the input terminal of the amplifying device can have an adjustable capacitance. In such a configuration, the current source can be assembled and the output current can be monitored. Thereafter, if noise appears in the output current, the capacitance of the adjustable capacitance can be adjusted, manually or automatically, until the noise is reduced to an acceptable level. Other configurations are also possible. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A low noise current source, comprising:

first and second current output terminals;

first and second voltage input terminals adapted to couple a voltage source;

an amplifying device comprising a device first input terminal, a device second input terminal, and a device output terminal, said device output terminal coupled to said first current output terminal, and said first voltage input terminal adapted to receive a time-varying noise signal which produces a time-varying noise current;

a bias circuit having a first resistive circuit and a second resistive circuit, said first resistive circuit coupled between said first voltage input terminal and said device first input terminal, and said second resistive circuit coupled between said device first input terminal and said second voltage input terminal; and a first bypass circuit coupled between said first voltage input terminal and said device first input terminal in parallel with said first resistive circuit, said first bypass circuit configured to provide a substantially high electrical resistance and substantially low electrical impedance to cause said amplifying device to cancel at least a portion of said time-varying noise current before said time-varying noise current flows out of said low noise current source.

2. The current source of claim 1, wherein said first bypass circuit comprises at least one capacitor disposed between said first voltage input terminal and said device first input terminal.

3. The current source of claim 1, further comprising:

a second bypass circuit coupled between said second voltage input terminal and said device first input terminal, said second bypass circuit configured to provide a substantially high electrical resistance and substantially low impedance between said second voltage input terminal and said device first input terminal.

4. The current source of claim 1, wherein at least one of said device output terminal and said second voltage supply terminal is coupled to a respective one of said first and said second current output terminals using at least one sense resistor.

5. The current source of claim 1, wherein said amplifying device comprises an operational amplifier.

6. The current source of claim 1, wherein said amplifying device comprises a transistor.

7. The current source of claim 1, wherein said time-varying noise current flows from said device second input terminal to said device output terminal and is at least partially cancelled by a current flowing from said device first input terminal to said device output terminal.

8. A low noise current source, comprising:

first and second current output terminals;

first and second voltage input terminals adapted to couple a voltage source;

a transistor having a control node, a first current node, and a second current node, said first current node coupled to said first voltage input terminal, said first voltage input terminal receiving a time-varying noise signal which produces a time-varying noise current;

a bias circuit having a first resistive circuit and a second resistive circuit and being coupled between said first voltage input terminal, said second voltage input terminal, and said control node, said first resistive circuit coupled between said first voltage input terminal and said control node; and a first bypass circuit coupled between said first voltage input terminal and said control node in parallel with said first resistive circuit, said first bypass circuit configured to provide a substantially high electrical resistance and substantially low electrical impedance to cause said transistor to cancel at least a portion of said time-varying noise current before said time-varying noise current flows out of said low noise current source.

9. The current source of claim 8, wherein said first bypass circuit comprises at least one capacitor disposed between said first voltage input terminal and said control node.

10. The current source of claim 9, wherein the capacitor comprises an adjustable capacitor.

11. The current source of claim 8, further comprising:

a second bypass circuit coupled between said second voltage input terminal and said control node, said second bypass circuit configured to provide a substantially high electrical resistance and substantially low impedance between said second voltage input terminal and said control node.

12. The current source of claim 11, wherein said second bypass circuit comprises at least one capacitor disposed between said second voltage input terminal and said control node.

13. The current source of claim 8, wherein said first current node is coupled to said first voltage input terminal using at least one node resistor, and wherein at least one of said second current node and said second voltage supply terminal is coupled to a respective one of said first and said second current output terminals using at least one sense resistor.

14. The current source of claim 8, wherein said time-varying noise current is at least partially cancelled by a current flowing from said base to said collector.

15. A method of providing a low noise current using a bipolar junction transistor having a base, an emitter, and a collector, the method comprising:

coupling said emitter to a first voltage input terminal of a direct current (DC) voltage supply outputting a time-varying noise current that flows into said emitter;

coupling said collector to a first load terminal of a load;

coupling a second voltage input terminal of said DC voltage supply to a second load terminal of said load;

generating a bias voltage at said base using a bias circuit coupled between said first voltage input terminal, said second voltage input terminal, and said base; and providing a first bypass current path between said first voltage input terminal and said base having a substantially high electrical resistance and substantially low impedance to cause said transistor to cancel at least a portion of said time-varying noise current thereby producing said low noise current.

16. The method of claim 15, wherein said providing said first bypass current path comprises connecting said first voltage input terminal and said base using at least one capacitor.

17. The method of claim 16, wherein said providing further comprises:

selecting said capacitor to comprise an adjustable capacitor, monitoring an output current at said load, and adjusting said adjustable capacitor to reduce a noise in said output current.

18. The method of claim 15, further comprising:

providing a second bypass current path between said second voltage input terminal and said base having a substantially high electrical resistance and substantially low impedance.

19. The method of claim 18, wherein said providing said second bypass current path comprises connecting said second voltage input terminal and said base using at least one capacitor.

20. The method of claim 15, wherein said coupling said emitter to said first voltage input terminal comprises connecting said emitter to said first voltage input terminal using at least one resistor.

21. The method of claim 15, further comprising coupling at least one of said collector and said second voltage supply terminal and a respective one of said first and said second load terminals using at least one sense resistor.

22. A method of providing a low noise current using an amplifying device having a device first input terminal, a device second input terminal and a device output terminal, said method comprising:

coupling a bias circuit between a first terminal and a second terminal of a voltage source having a voltage with a direct current component and a noise component, said bias circuit having a first resistive circuit, a second resistive circuit, and a bias node connecting said first resistive circuit and said second resistive circuit and coupled to said device first input terminal;

coupling a third resistive circuit between said first terminal and said device second input terminal, said voltage generating a direct current and a time-varying noise current in said third resistive circuit; and generating a bypass voltage at said bias node configured to cause said amplifying device to cancel at least a portion of said time-varying noise current.

23. The method of claim 22, wherein said generating said bypass voltage comprises coupling a bypass circuit having a substantially high electrical resistance and substantially low impedance between said first terminal and said device first input terminal.

24. The method of claim 23, wherein said bypass circuit comprises a capacitor.

25. The method of claim 24, wherein said capacitor is an adjustable capacitor, further comprising monitoring an output current flowing through a load coupled to said device output terminal and adjusting said adjustable capacitor to reduce a noise in said output current.

26. The method of claim 23, wherein said first resistive circuit is coupled in parallel with said bypass circuit.

* * * * *